US010127895B2

(12) United States Patent
Deering et al.

(10) Patent No.: US 10,127,895 B2
(45) Date of Patent: Nov. 13, 2018

(54) CONTOURED BANJO BRIDGE

(71) Applicant: Deering Banjo Company, Inc., Spring Valley, CA (US)

(72) Inventors: Charles Greg Deering, El Cajon, CA (US); Jens H. Kruger, North Wilkesboro, NC (US)

(73) Assignee: Deering Banjo Company, Inc., Spring Valley, CA (US)

( * ) Notice: Subject to any disclaimer, the term of this patent is extended or adjusted under 35 U.S.C. 154(b) by 22 days.

(21) Appl. No.: 15/490,067

(22) Filed: Apr. 18, 2017

(65) Prior Publication Data

US 2017/0309259 A1 Oct. 26, 2017

Related U.S. Application Data

(60) Provisional application No. 62/325,271, filed on Apr. 20, 2016.

(51) Int. Cl.
*G10D 3/04* (2006.01)
*G10D 1/10* (2006.01)

(52) U.S. Cl.
CPC ..... *G10D 3/04* (2013.01); *G10D 1/10* (2013.01)

(58) Field of Classification Search
CPC ..... G10D 3/04; G10D 1/10
See application file for complete search history.

(56) References Cited

U.S. PATENT DOCUMENTS

| | | | | |
|---|---|---|---|---|
| 3,447,411 A * | 6/1969 | Bloxsom, Jr. | G10D 1/04 84/264 |
| 4,667,559 A * | 5/1987 | Plescia | G10D 3/04 84/309 |
| 4,899,634 A * | 2/1990 | Geiger | G10D 3/04 84/299 |
| 2013/0055876 A1* | 3/2013 | Mason | G10D 3/04 84/298 |

* cited by examiner

*Primary Examiner* — Kimberly Lockett
(74) *Attorney, Agent, or Firm* — Richard D. Clarke

(57) ABSTRACT

The present invention is directed to a Contoured Banjo Bridge with a flat upper surface for making contact with and securing the strings present on a stringed instrument and one or more convex overall lower surfaces which makes contact with the head of said stringed instrument, to maintain a uniform pressure with the banjo head surface when the strings are tightened, whereby the convex lower portion of the banjo bridge has a curved lower surface to compensate for the stress applied onto the head of the stringed instrument when the strings are tightened. The Contoured Banjo Bridge may be constructed with one or more openings to achieve the intended purpose of this application.

20 Claims, 3 Drawing Sheets

CONTOURED BANJO BRIDGE

FIELD OF THE INVENTION

The present invention is directed to a variable radius convex curved contoured banjo bridge, and more particularly to a banjo bridge having a user defined convex variable radius curvature of the base surface, wherein said curved surface contacts the banjo head, and a straight upper surface, wherein the upper surface supports the banjo strings.

BACKGROUND OF THE INVENTION

The banjo is a stringed instrument with, typically, four or five strings, which vibrate a membrane of plastic material or animal hide stretched over a circular frame. The banjo is usually associated with country, folk, classical music, Irish traditional music and bluegrass music. Recently, the banjo has enjoyed inclusion in a wide variety of musical genres, including pop crossover music, indie rock and Celtic punk.

The modern banjo comes in a variety of forms, including four- and five-string versions. A six-string version, tuned and played similarly to a guitar, has gained popularity. In almost all of its forms, banjo playing is characterized by a fast arpeggiated plucking, though there are many different playing styles.

The body, or "pot," of a modern banjo typically consists of a circular rim (generally made of wood, though metal was also common on older banjos) and a tensioned head, similar to a drum head. Traditionally the head was made from animal skin, but today is often made of various synthetic materials. Most modern banjos also have a metal "tone ring" assembly that helps further clarify and project the sound, however, many older banjos did not include a tone ring.

Modern banjos are typically strung with metal strings. Usually the fourth string is wound with either steel or bronze-phosphor alloy. Some banjo players may string their banjos with nylon or gut strings to achieve a mellower, old-time tone.

One of the most critical parts of a banjo is the bridge. Varying the banjo bridge can change the sound quality and sound character or tone of a banjo. The mass of the bridge is extremely important for proper banjo tone production, and this is a primary purpose of proper banjo setup. A heavy bridge will mute the instrument, and for this reason, many experienced banjo players routinely remove excess wood from bridges with a Dremel® Tool,®, or the like. This will increase the volume and brighten the sound. Some banjo players do not usually find it necessary to alter these bridges by removing any wood from them. The bridge on a banjo is not permanently attached to the head, so it is possible for a bridge to move out of position.

The reason for banjo bridges having openings is to cut down on the mass of the bridge. Heavier bridges make for a mellower tone. Very light bridges make a bright sound. Most banjo players and builders already know it takes a very heavy dense wood to give a good banjo sound. Maple has been traditionally used to construct banjo bridges, but it has to be shaved very thin to compensate for the inherent heaviness of the wood. Neither the number of feet, nor the sizes of space between feet openings in the bridge base seem to affect the tone.

Some banjo bridges have string saddles, but this is optional. Likewise, some banjo bridges have an optional block of material positioned between the bridge and the strings, often this block is formed from a very hard material. A very hard material will add to the brilliance, overtones and sustaining of a note. Ebony, ivory, many plastics, and pearl is what is typically recommend in constructing a single large block or numerous individual blocks positioned under each string.

While all banjos and related instruments have a bridge, the configuration of the conventional banjo bridge has remained relatively unchanged for hundreds of years, and it is the purpose of the present invention to introduce a remarkable new change to banjo bridge configuration.

The banjo bridge provided in the prior art that is described may be suitable for the specific individual purposes to which it addressed, it differs from the present design as hereinafter contrasted. The following is a summary of the prior art patent most relevant to this application at hand, as well a description outlining the difference between the features of the Contoured Banjo Bridge and the prior art.

U.S. Pat. No. 8,759,650 of Charles D. Deering describes a separate tone plate bridge base mechanical string energy initial peak compression device for a banjo comprising: a) a separate tone flat plate positioned between the banjo drum head and the banjo bridge which is retrofitted beneath the banjo bridge; and wherein said separate tone flat plate acts as a limiter to initial peak energy coming from the strings when the banjo is played for the purpose of increasing the level of energy released during sustain time, thus enabling a banjo player to play music with increased sustain, thereby enabling a broader general use of the instrument.

This patent does not provide the benefits attendant with the Contoured Banjo Bridge. The present design achieves its intended purposes, objects and advantages over the prior art device through a new, useful and unobvious combination of method steps and component elements.

In this respect, before explaining at least one embodiment of the Contoured Banjo Bridge in detail it is to be understood that the design is not limited in its application to the details of construction and to the arrangement of the components set forth in the following description or illustrated in the drawings. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures for carrying out the several purposes of the present design. It is important, therefore, that the claims be regarded as including such equivalent construction insofar as they do not depart from the spirit and scope of the present application.

SUMMARY OF THE INVENTION

The principle advantage of this invention is to provide a Contoured Banjo Bridge having a curved bottom which significantly improves the overall sound quality produced by a banjo equipped with said inventive contoured banjo bridge.

Another advantage of this invention is to provide a Contoured Banjo Bridge having a curved bottom wherein the lower surface, that surface which makes contact with the banjo head, can be selectively constructed in varying convex curved radius sizes desired by the banjo player.

Another advantage of this invention is to provide a Contoured Banjo Bridge having a curved bottom which can be constructed in varying curved bottom surface radius configurations, including a true radius shape, and a parabolic and hyperbolic shape as required.

Another advantage of this invention is to provide a Contoured Banjo Bridge having a curved bottom radius where the flat upper surface, that surface which makes contact with the banjo strings, remains flat and is not deformed by the pressures of the strings when they are tightened.

Another advantage of this invention is to provide a Contoured Banjo Bridge having a curved bottom which significantly improves the amplitude and tonal quality of the sound produced by a banjo equipped with said inventive Contoured Banjo Bridge.

Another advantage of this invention is to provide a Contoured Banjo Bridge having a curved bottom which enables the optimal use of nylon strings as well as steel strings on a banjo equipped with said inventive Contoured Banjo Bridge.

Another object of this invention is to provide a Contoured Banjo Bridge having a curved bottom which produces a less harsh and less "clangy" sound on a banjo equipped with said inventive Contoured Banjo Bridge.

Another object of this invention is to provide a Contoured Banjo Bridge having a curved bottom which produces more sustain on a banjo equipped with said inventive Contoured Banjo Bridge.

Another object of this invention is to provide a Contoured Banjo Bridge having a curved bottom which is easily installed on any existing banjo.

Another object of this invention is to provide a Contoured Banjo Bridge which is readily manufactured and constructed of numerous materials including dense wood, light wood, ebony, ivory, composites, many hard plastics, and pearl.

And yet a further object of this invention is to provide a Contoured Banjo Bridge having a curved bottom which enables banjo instruments to better blend with other instruments.

The reason for banjo bridges having openings is to cut down on the mass of the bridge. Heavier bridges make for a mellower tone. Very light bridges make a bright sound. Breaking the banjo bridge into separate feet is to allow the bridge to flex to the concave shape of the head, keeping the contact pressure even across the base of the bridge when the strings are tightened. The looser the head or the tighter the strings the more of a curve the bridge must conform to. This action is what causes the undesirable concavity of the upper surface (that surface which makes direct contact with the strings) of the conventional banjo bridge.

To compensate for this, the Contoured Banjo Bridge has been designed with a flat upper surface and convex overall lower surfaces to maintain a uniform pressure with the banjo head surface when the strings are tightened. The Contoured Banjo Bridge may be constructed with one or more openings to achieve the intended purpose of this application. Maple has been traditionally used to construct banjo bridges, but a variety of other hard woods will work equally as well.

The upper surface of the bridge may or may not have a laminated, very hard material that will add to the brilliance, overtones and sustain of a note. Ebony, ivory, composites, many hard plastics, and pearl is what is typically used in constructing a single large block or numerous individual blocks which are positioned under each string.

The curved bottom Contoured Banjo Bridge can be constructed using many radius variations. Smaller radius bottoms will conform to looser heads used on more mellow sounding open back banjos. Medium radiuses are used for standard head tensions in the "G" to "A" range. Larger radiuses are used for tight heads in the "B" and above ranges. A true radius makes for a good bright tone that unlocks the midrange response that is missing with a flat bottom bridge. A non-true radius, such as a hyperbolic or parabolic curve, or any other non-true radius curve can be used to fine tune a particular artists/banjo player's needs. A parabolic curve will result in a "little bit sweeter" sound than a true radius.

The loose head true radius range is 18 to 26 inches, while the standard tension true radius range is 26 to 36 inches and the tight head true tension radius range is 36 to 50 inches. Any number of varying hyperbolic and parabolic curves can also be used for the shape of the Contoured Banjo Bridge bottom curved surface.

The foregoing has outlined rather broadly the more pertinent and important features of the present Contoured Banjo Bridge in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Contoured Banjo Bridge and together with the description, serve to explain the principles of this application.

For a fuller understanding of the nature and advantages of the Contoured Banjo Bridge, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
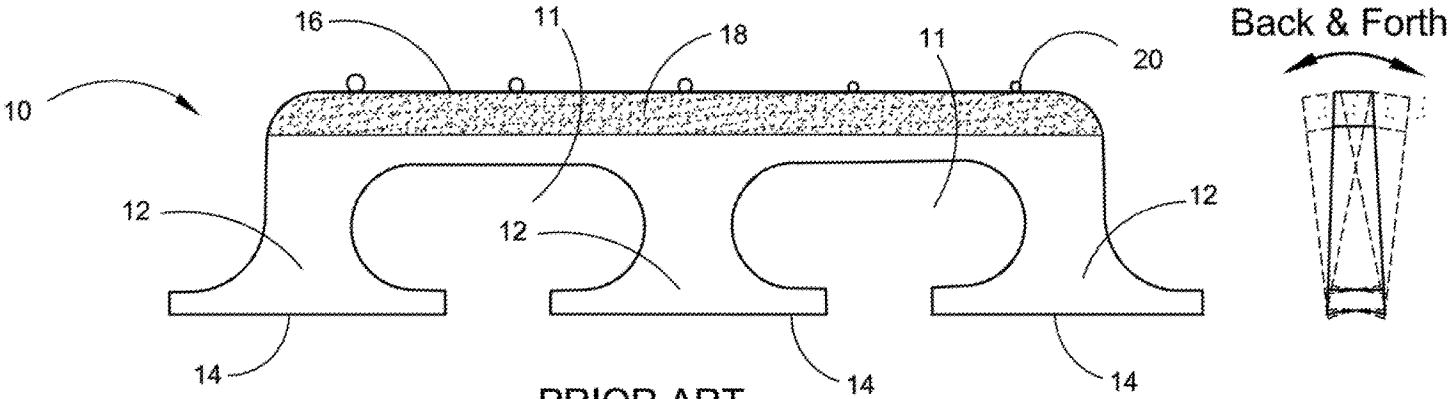
PRIOR ART FIG. 1
FIG. 1 depicts a front view of the prior art conventional banjo bridge.

Referring now to the drawings, wherein similar parts of the instant Contoured Banjo Bridge invention are identified by like reference numerals, there is seen in FIG. 1 a front view of the prior art conventional banjo bridge 10. The conventional banjo bridge 10 is shown with two openings 11 creating three foot sections 12 with their lower surface 14 parallel to the upper surface 16 and having a laminated material 18 with four banjo strings 20.

Figure 2:
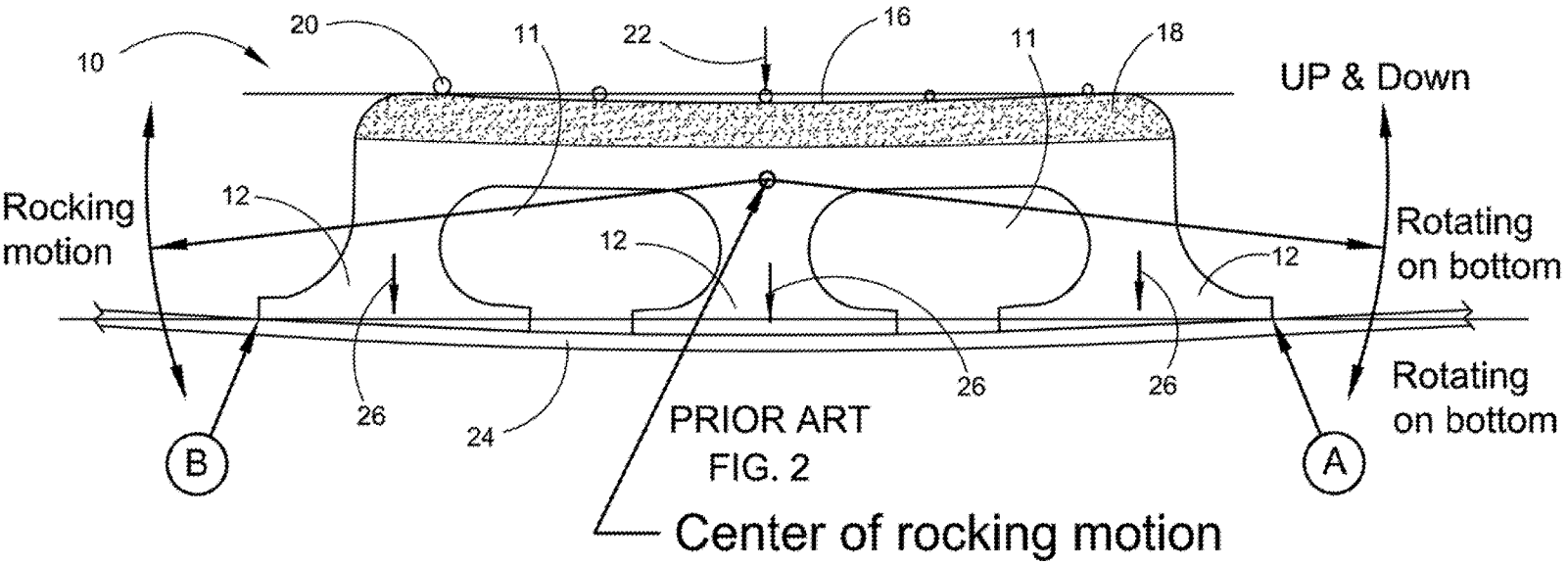
PRIOR ART FIG. 2
FIG. 2 depicts a front view of the prior art conventional banjo bridge with the strings exerting a downward pressure on the banjo head deforming the bridge.

FIG. 2 depicts a front view of the prior art conventional banjo bridge 10 with the strings 20 tightened. This exerts a downward pressure 22 on the conventional banjo bridge 10, deforming the upper surface 16 and exerts a secondary pressure 26 on the three lower foot sections 12 deforming the banjo head 24. When this sagging deformity of the upper surface of the conventional bridge occurs, that surface which makes direct contact with the banjo strings, the overall sound quality of the banjo is negatively affected.

Figure 3:
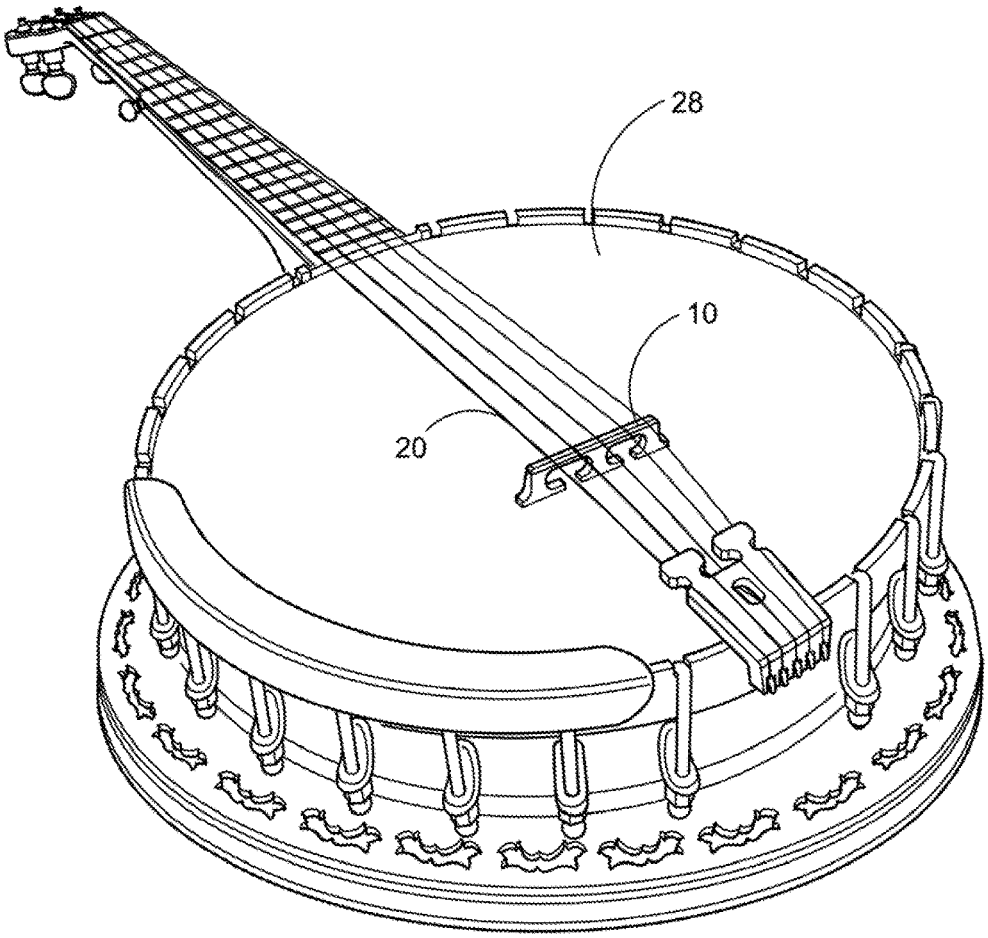
FIG. 3 depicts a perspective view of a conventional banjo illustrating the mounting location of the bridge.

FIG. 3 depicts a perspective view of a banjo 28 illustrating the mounting location of the banjo bridge 10.

Figure 4:
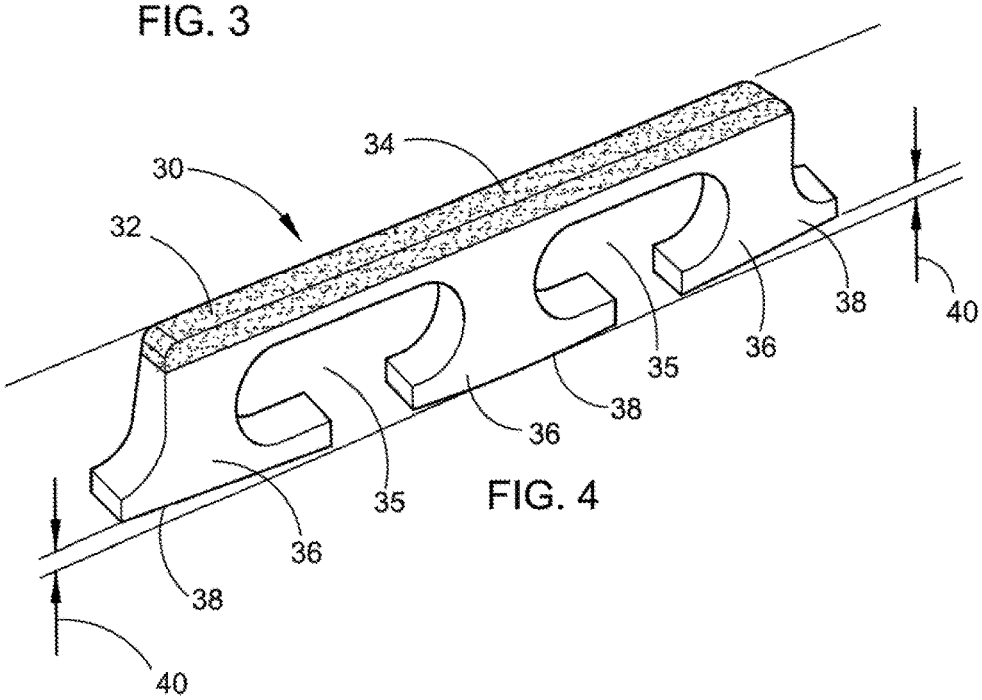
FIG. 4 depicts a perspective view of the Contoured Banjo Bridge illustrating the straight upper surface and the convex lower surface.

FIG. 4 depicts a perspective view of the Contoured Banjo Bridge 30 illustrating the straight and flat upper surface 32 with the laminated material 34 having openings 35 and the foot sections 36 with convex curved lower surfaces 38. The angle 40 indicates the amount of convex curvature of the lower surfaces 38. This may vary depending upon the number of strings on the banjo 28 and the type of material of the banjo head 24 and will still remain within the scope of this application.

The convex curved bottom Contoured Banjo Bridge can be constructed using many convex radius variations. Smaller convex radius bottoms will conform to looser heads used on more mellow sounding open back banjos. Medium radiuses are used for standard head tensions in the "G" to "A" range. Larger convex radiuses are used for tight heads in the "B" and above ranges. A true convex radius makes for a good bright tone that unlocks the midrange response that is missing with a flat bottom bridge. A non-true convex radius, such as a convex hyperbolic or parabolic curve, or any other non-true convex radius curve can be used to fine tune a particular artists/banjo player's needs. A parabolic curve will result in a "little bit sweeter" sound than a true radius.

The loose head true radius range is 18 to 26 inches, while the standard tension true radius range is 26 to 36 inches and the tight head true tension radius range is 36 to 50 inches. Any number of varying hyperbolic and parabolic curves can also be used for the shape of the Contoured Banjo Bridge bottom curved surface.

Figure 5:
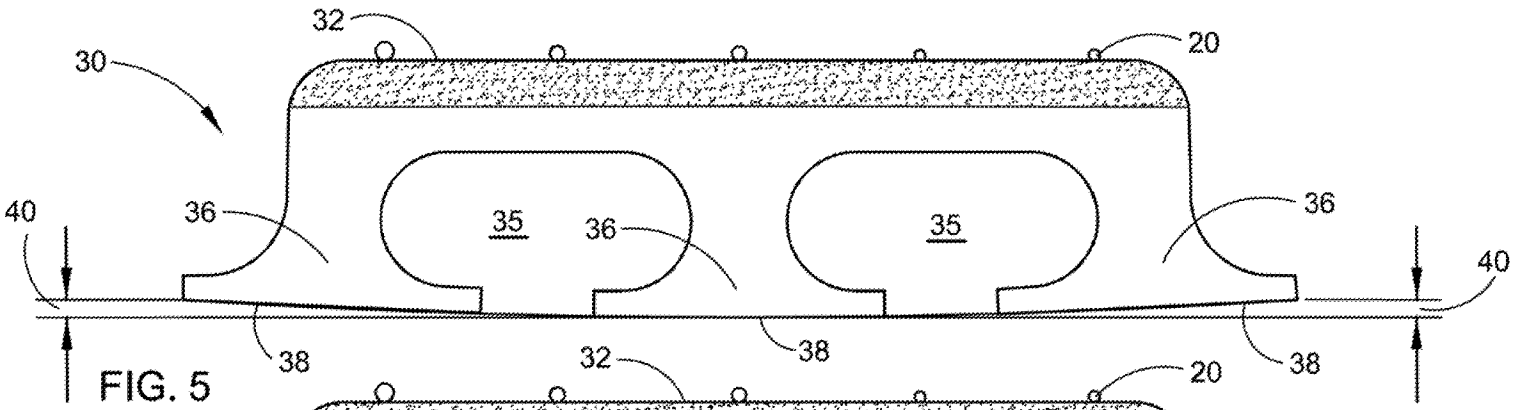
FIG. 5 depicts a front view of the Contoured Banjo Bridge illustrating the convexity of the lower surface.

FIG. 5 depicts a front view of the Contoured Banjo Bridge 30 illustrating the convexity of the lower surface 38 while the upper surface 32 remains flat and the angle 40 that indicates the amount of convex curvature of the lower surfaces 38.

Figure 6:
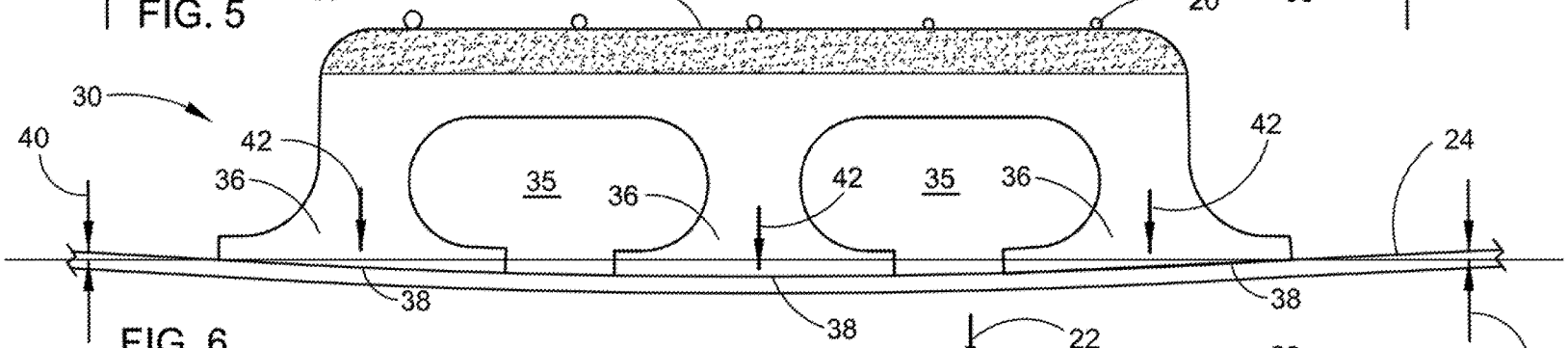
FIG. 6 depicts a front view of the Contoured Banjo Bridge illustrating the depression of the banjo head surface when the strings are tightened.

FIG. 6 depicts a front view of the Contoured Banjo Bridge 30 illustrating the secondary pressure 42 on the foot sections 36 depressing the banjo head 24 surface when the banjo strings 20 are tightened. Here the Contoured Banjo Bridge 30 has two openings 35, but it may also be constructed of a single piece, with no openings present.

Figure 7:
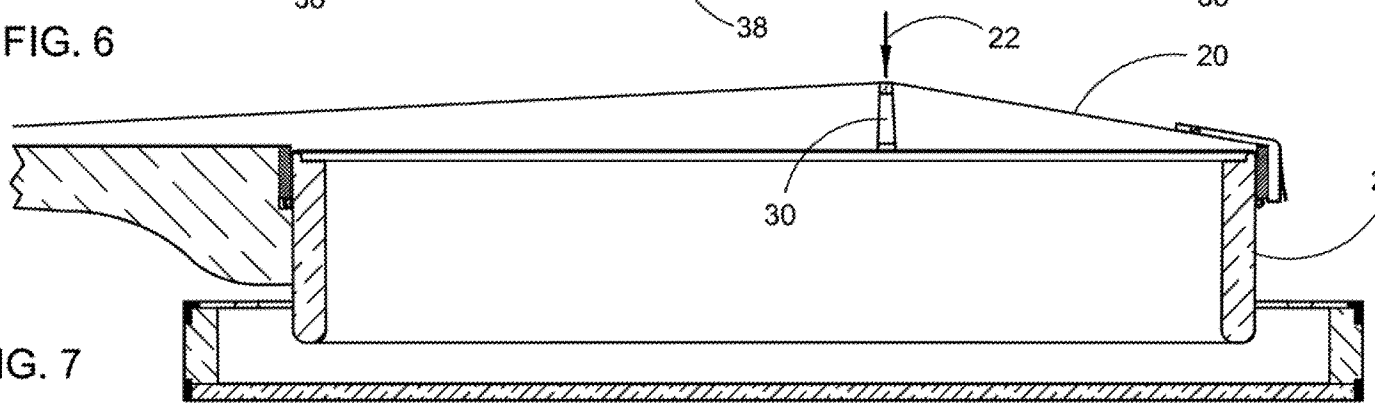
FIG. 7 depicts a side view of a typical banjo with the location of the Contoured Banjo Bridge indicated.

FIG. 7 depicts a side view of a typical banjo head 24 with the location of the Contoured Banjo Bridge 30 and the downward pressure 22 exerted when the banjo strings 20 are tightened.

The Contoured Banjo Bridge 30 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Contoured Banjo Bridge 30 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A contoured banjo bridge comprising:

a) a bridge member for installation on, a banjo having an upper portion including a bridge member upper surface which makes direct contact with and secures the strings present on a banjo;

b) said bridge member having a lower portion including a bridge member lower surface which makes direct contact with the flexible head of a banjo, wherein said bridge member lower surface includes a convex curved lower surface to compensate for the stress applied to the flexible head of the banjo when the strings are tightened;

and further wherein said bridge member curved lower surface is curved in a convex radius curve such that when the banjo strings are tightened and the flexible head of the banjo bends under the pressure, the entire bottom surface of said bridge member curved lower surface remains in contact with the flexible head of the banjo, thereby increasing the transfer of a plucked string's vibration energy to the banjo head to amplify that vibration energy into audible sound, resulting in higher quality tone.

2. The contoured banjo bridge according to claim 1, wherein said bridge member lower convex curved surface which makes direct contact with the flexible head of a banjo, is shaped in a true convex radius curve.

3. The contoured banjo bridge according to claim 2, wherein, said bridge member lower convex curved surface which makes direct contact with the flexible head of a banjo, is shaped in a true convex radius curve includes a loose head tension radius range of about 18 inches to about 26 inches.

4. The contoured banjo bridge according to claim 2, wherein said bridge member lower convex curved surface which makes direct contact with the flexible head of a banjo, is shaped in a true convex radius curve includes a standard head tension radius range of about 26 inches to about 36 inches.

5. The contoured banjo bridge according to claim 2, wherein said bridge member lower convex curved surface which makes direct contact with the flexible head of a banjo, is shaped in a true convex radius curve includes a tight head tension radius range of about 36 inches to about 50 inches.

6. The contoured banjo bridge according to claim 1, wherein said bridge member lower convex curved surface which makes direct contact with the flexible head of a banjo, is shaped in a convex hyperbola.

7. The contoured banjo bridge according to claim 1, wherein said bridge member lower convex curved surface which makes direct contact with the flexible head of a banjo, is shaped in a convex parabola.

8. The contoured banjo bridge according to claim 1, wherein said bridge member lower portion is constructed of hard wood.

9. The contoured banjo bridge according to claim 1, wherein said wherein said bridge member upper portion includes a laminated hard material which makes direct contact with the strings, located on the upper surface of said bridge member upper portion.

10. The contoured banjo bridge according to claim 1, wherein said bridge member lower portion includes one or more openings.

11. A method for making a contoured banjo bridge comprising:

a) providing a bridge member for installation on a banjo having a bridge member upper portion including an upper surface which makes direct contact with and secures the strings present on a banjo;

b) providing said bridge member having a lower portion including a bridge member lower surface which makes direct contact with the flexible head of a banjo, wherein said bridge member lower surface includes a convex curved lower surface to compensate for the stress applied to the flexible head of the banjo when the strings are tightened;

and further wherein said bridge member curved lower surface is curved in a convex radius curve such that when the banjo strings are tightened and the flexible head of the banjo bends under the pressure, the entire bottom surface of said bridge member curved lower surface remains in contact with the flexible head of the banjo, thereby increasing the transfer of a plucked strings vibration energy to the banjo head to amplify that vibration energy into audible sound, resulting in higher quality tone.

12. The method for making a contoured banjo bridge according to claim 11, wherein said bridge member lower convex curved surface which makes direct contact with the flexible head of a banjo, is shaped in a true convex radius curve.

13. The method for making a contoured banjo bridge according to claim 12, wherein said bridge member lower convex curved surface which makes direct contact with the flexible head of a banjo, is shaped in a true convex radius curve includes a loose head tension radius range of about 18 inches to about 26 inches.

14. The method for making a contoured banjo bridge according to claim 12, wherein said bridge member lower convex curved surface which makes direct contact with the flexible head of a banjo, is shaped in a true convex radius curve includes a standard head tension radius range of about 26 inches to about 36 inches.

15. The method for making a contoured banjo bridge according to claim 12, wherein said bridge member lower convex curved surface which makes direct contact with the flexible head of a banjo, is shaped in a true convex radius curve includes a tight head tension radius range of about 36 inches to about 50 inches.

16. The method for making a contoured banjo bridge according to claim 11, wherein said bridge member lower convex curved surface which makes direct contact with the flexible head of a banjo, is shaped in a convex hyperbola.

17. The method for making a contoured banjo bridge according to claim 11, wherein said bridge member lower convex curved surface which makes direct contact with the flexible head of a banjo, is shaped in a convex parabola.

18. The method for making a contoured banjo bridge according to claim 11, wherein said bridge member lower portion is constructed of hard wood.

19. The method for making a contoured banjo bridge according to claim 11, wherein said bridge member upper portion includes a laminated hard material which makes direct contact with the strings, located on the upper surface of said bridge member upper portion.

20. The method for making a contoured banjo bridge according to claim 11, wherein said bridge member lower portion includes one or more openings.

* * * * *